US011627768B2

(12) United States Patent
Pearson

(10) Patent No.: US 11,627,768 B2
(45) Date of Patent: Apr. 18, 2023

(54) MULTI-USE ARTICLE WITH QUICK RELEASE CLOSURE

(71) Applicant: Tucker Hamilton Pearson, Flowery Branch, GA (US)

(72) Inventor: Tucker Hamilton Pearson, Flowery Branch, GA (US)

( * ) Notice: Subject to any disclaimer, the term of this patent is extended or adjusted under 35 U.S.C. 154(b) by 0 days.

(21) Appl. No.: 17/210,795

(22) Filed: Mar. 24, 2021

(65) Prior Publication Data

US 2021/0298392 A1 Sep. 30, 2021

Related U.S. Application Data

(60) Provisional application No. 62/994,379, filed on Mar. 25, 2020.

(51) Int. Cl.
*A41D 15/04* (2006.01)
*A41D 3/02* (2006.01)

(52) U.S. Cl.
CPC ..... *A41D 15/04* (2013.01); *A41D 3/02* (2013.01); *A41D 2300/32* (2013.01)

(58) Field of Classification Search
CPC ..... A41D 15/04; A41D 15/00; A41D 15/007; A41D 3/00; A41D 3/02; A41D 3/005; A41D 3/08; A41B 13/00; A41B 13/06
USPC ..... 2/70, 84, 85, 93, 95, 103, 111
See application file for complete search history.

(56) References Cited

U.S. PATENT DOCUMENTS 834,418 A * 10/1906 Skinner ..... A41D 3/02 2/85
1,079,798 A * 11/1913 Painter ..... A41B 13/06 5/413 R
1,355,177 A * 10/1920 Sollen ..... D03D 11/00 112/420
2,030,091 A * 2/1936 Behringer ..... A41B 13/06 2/114

(Continued)

FOREIGN PATENT DOCUMENTS

DE 102007037968 A1 * 2/2009 ..... A41D 1/04
DE 102018105989 A1 * 9/2019
GB 784143 A * 10/1957

OTHER PUBLICATIONS

"Ball Bungees: Not Just for Tarps Anymore". US Cargo Control. URL="https://blog.uscargocontrol.com/ball-bungees-just-tarps/" Accessed Apr. 8, 2022. (Year: 2014).*

*Primary Examiner* — Jameson D Collier
(74) *Attorney, Agent, or Firm* — Chambliss, Bahner & Stophel, P.C.; Stephen D. Adams

(57) ABSTRACT

A multi-use article having a blanket having inward-facing and outward-facing sides and a cover mounted to the inward-facing side of the blanket. The cover may be worn by a wearer by being placed onto and covering at least a portion of a torso of the wearer and, when worn, to carry the blanket. A head opening permits a head of the wearer to extend out of the cover when the cover is placed onto the torso of the wearer. Arm openings allow arms of the wearer to extend out of the cover when the cover is placed onto the torso of the wearer. Shoulder contact portions are located adjacent opposing sides of the head opening. Each shoulder contact portion contacts a shoulder of the wearer when the cover is placed onto the torso of the wearer such that the cover is carried on the shoulders of the wearer.

14 Claims, 6 Drawing Sheets

(56) References Cited

U.S. PATENT DOCUMENTS

| | | | | | |
|---|---|---|---|---|---|
| 2,140,797 | A * | 12/1938 | Hammerman | A47D 15/008 | 2/114 |
| 2,215,951 | A * | 9/1940 | Astrove | A41B 13/06 | 2/114 |
| 2,355,138 | A * | 8/1944 | Bell | A41B 13/06 | 2/114 |
| 2,419,989 | A * | 5/1947 | Day | A47D 15/008 | 2/114 |
| 2,439,101 | A * | 4/1948 | Rogers | A41B 13/06 | 2/114 |
| 2,462,165 | A * | 2/1949 | Condon | A41B 13/06 | 2/69.5 |
| 2,465,622 | A * | 3/1949 | Widetsky | A41B 13/06 | 128/873 |
| 2,589,596 | A * | 3/1952 | Auer | A41B 13/06 | 2/69.5 |
| 2,734,194 | A * | 2/1956 | Colvin | A41B 13/00 | D2/733 |
| 4,853,996 | A * | 8/1989 | Harrigan | A61F 5/3776 | 5/494 |
| 6,266,822 | B1 * | 7/2001 | Joyce | A47G 9/083 | 2/69.5 |
| 6,341,378 | B1 * | 1/2002 | Pietsch | A41D 3/06 | 2/87 |
| 6,676,188 | B1 * | 1/2004 | McKinney | B62J 17/065 | 296/81 |
| 8,276,224 | B1 * | 10/2012 | von Yurt | A47G 9/0246 | 5/655 |
| 2010/0146680 | A1 * | 6/2010 | Cuoco | A41D 3/08 | 2/84 |
| 2013/0239290 | A1 * | 9/2013 | Rossi | A41D 15/04 | 2/84 |

* cited by examiner

MULTI-USE ARTICLE WITH QUICK RELEASE CLOSURE

CROSS-REFERENCE TO RELATED APPLICATIONS

This application claims the benefit of U.S. Provisional Application No. 62/994,379 filed Mar. 25, 2020, and entitled APPAREL WITH QUICK RELEASE CLOSURE, which is incorporated herein by reference in its entirety.

FIELD

This invention relates generally to multi-purpose, highly-mobile, and quick deploying articles. More particularly, the present invention relates to a blanket, poncho, comforter, or similar article that is provided with quick release closures and storage pockets that permit conversion into one or more other articles, such as an article of clothing (e.g., capes, jacket, vest), pillow, robe, sleeping bag, etc.

BACKGROUND

Operational use of outdoor gear in harsh and inclement weather environments is necessary but difficult. Use of such outdoor gear often results in impaired mobility and functionality, especially in high operational tempo environments (i.e., high speed and intensity of action), where dexterity and speed of movement is often needed). Outdoor gear is often utilized by wearers in remote locations, where hiking to and from the location is required and the wearer often carries all of their gear on their person (i.e., worn on their person or carried in a pack). For this reason, it is usually advantageous to only carry gear that is necessary during the trip and that, preferably, has multiple different uses or modes of operation. Current outdoor gear is frequently too heavy, impairs functionality with other equipment, and limits the wearer's flexibility and has limited modes of operation and uses. Other outdoor gear is lightweight but is not heavy enough to keep the wearer warm enough in very cold environments and has limited modes of operation and uses. Fastening or closure mechanisms add weight to equipment and they are difficult to use quickly and consistently, especially in dark and wet conditions or when a wearer's hands are exposed to sub-freezing temperatures.

What is needed, therefore, is an improved, versatile, and weather appropriate garment having a quick release closure mechanism.

Notes on Construction

The use of the terms "a", "an", "the" and similar terms in the context of describing embodiments of the invention are to be construed to cover both the singular and the plural, unless otherwise indicated herein or clearly contradicted by context. The terms "comprising", "having", "including" and "containing" are to be construed as open-ended terms (i.e., meaning "including, but not limited to,") unless otherwise noted. The terms "substantially", "generally" and other words of degree are relative modifiers intended to indicate permissible variation from the characteristic so modified. The use of such terms in describing a physical or functional characteristic of the invention is not intended to limit such characteristic to the absolute value which the term modifies, but rather to provide an approximation of the value of such physical or functional characteristic.

Terms concerning attachments, coupling and the like, such as "attached", "connected" and "interconnected", refer to a relationship wherein structures are secured or attached to one another either directly or indirectly through intervening structures, as well as both moveable and rigid attachments or relationships, unless otherwise specified herein or clearly indicated as having a different relationship by context. The term "operatively connected" or "operatively attached" is such an attachment, coupling or connection that allows the pertinent structures to operate as intended by virtue of that relationship.

The use of any and all examples or exemplary language (e.g., "such as" and "preferably") herein is intended merely to better illuminate the invention and the preferred embodiments thereof, and not to place a limitation on the scope of the invention. Nothing in the specification should be construed as indicating any element as essential to the practice of the invention unless so stated with specificity.

SUMMARY

The above and other problems are addressed by a multi-use article having a blanket having an inward-facing side and an outward-facing side and a cover mounted to the inward-facing side of the blanket. The cover is configured to be worn by a wearer by being placed onto and covering at least a portion of a torso of the wearer and, when worn, to carry the blanket. A head opening permits a head of the wearer to extend out of the cover when the cover is placed onto the torso of the wearer. A pair of arm openings allow arms of the wearer to extend out of the cover when the cover is placed onto the torso of the wearer. Shoulder contact portions are located adjacent opposing sides of the head opening. Each shoulder contact portion contacts a shoulder of the wearer when the cover is placed onto the torso of the wearer such that the cover is carried on the shoulders of the wearer.

In certain embodiments, a hood is located proximate the head opening and is configured to cover a head of the wearer when the cover is placed onto the torso of the wearer, the head of the wearer extends out of the head opening, and the shoulder contacts are disposed on the shoulders of the wearer.

In certain embodiments, the torso cover includes a chest panel that is disposed adjacent a chest of the wearer and a back panel is disposed adjacent a back of the wearer and between the wearer and the inward-facing side of the blanket when the shoulder contacts are disposed on the shoulders of the wearer. In certain preferred embodiments, a hood is located proximate the head opening that is configured to cover a head of the wearer when the cover is placed onto the torso of the wearer, the head of the wearer extends out of the head opening, and the shoulder contacts are disposed on the shoulders of the wearer. First attachments are located on opposing sides of the head opening where the cover is attached to the inward-facing side of the blanket. Additionally, a first opening is located between the first attachments where the cover is not attached to the inward-facing side of the blanket. A pouch area is formed between the back panel of the cover and the inward-facing side of the blanket. The hood may be tucked for storage in the pouch area by being inserted through the first opening and into the pouch area.

In certain embodiments, a sleeve is located proximate each arm opening and is configured to cover an arm of the wearer when the cover is placed onto the torso of the wearer and the shoulder contacts are disposed on the shoulders of the wearer. Second attachments are located on opposing sides of the cover where the cover is attached to the blanket. Preferably, a second attachment is disposed adjacent each sleeve. Also, a second opening is formed on each side of the cover where the cover is not attached to the blanket. Each second opening is formed between one of the first attachments and one of the second locations. Each sleeve may be inserted through one of the second openings and stored inside of the pouch area.

In certain embodiments, separate sleeve retainer are configured to selectively hold each sleeve together with a portion of the blanket such that, (i) when a wearer's arms are in the sleeves and the sleeves are held against the blanket by the sleeve retainers, movement of the wearer's arms within the sleeves causes said portions of the blanket to move with the wearer's arms and, (ii) when a wearer's arms are in the sleeves and the sleeves are not held against the blanket by the sleeve retainers, movement of the wearer's arms within the sleeves does not cause said portions of the blanket to move with the wearer's arms. In certain embodiments, the sleeve retainers are elastic retainers attached to the blanket and form an opening through which one of the sleeves may be inserted in order to be selectively held together with said portion of the blanket. In certain embodiments, the sleeves are long sleeves that are each configured to cover substantially the entirety of the arm. A top end of each sleeve is attached to the cover at the arm openings and a bottom end of each sleeve terminated with a hand opening through which a hand of the wearer may extend out of the sleeve.

In certain embodiments, a first closure half and a corresponding second closure half are attached to opposing left and right portions of the blanket and on either side of the cover. The first and second closure halves may be selectively joined together in order to connect the left and right portions of the blanket together such that the blanket surrounds the wearer. Certain preferred embodiments include separate arm retainers attached to opposing left and right portions of the blanket and on either side of the cover. Each arm retainer has an opening through which a portion of an arm of the wearer may be placed such that: (i) when a wearer's arms are in the arm retainers, movement of the wearer's arms causes the blanket to move with the movement of the wearer's arms and, (ii) when a wearer's arms are not in the arm retainers, movement of the wearer's arms does not cause the blanket to move with the movement of the wearer's arms. In certain cases, the arm retainer is located on the blanket such that, when the wearer's arm is inserted through the opening of the arm retainer, the arm retainer is positioned between an elbow and a wrist of the wearer. Additionally, the first and second closure halves are located such that they may be grasped by hands of the wearer and joined together in order to connect the left and right portions of the blanket together such that the blanket surrounds the wearer when the wearer's arm are inserted through the openings of the arm retainers.

In certain preferred embodiments, first and second closure halves are located proximate a top end of the blanket on either side of the head opening such that, when the closure halves are joined together and the head of the wearer extends out of the head opening, the blanket is secured around a neck of the wearer. In some cases, the first and second closure halves are attached to the inward-facing side of the blanket. In certain embodiments, the first closure half includes a ball portion and the second closure half includes an elastic loop. Additionally, the first and second closure halves are joined together by passing the ball through an opening formed in the elastic loop such that ball is removably retained by the loop.

In certain embodiments, the blanket is sized and configured to extend below knees of a wearer when the shoulder contacts of the cover are disposed on the shoulders of the wearer. In certain embodiments, the blanket is formed from a first fabric layer, a second fabric layer, and a batting layer disposed between the first and second fabric layers.

In another embodiment of the present invention, a jacket includes a back panel having an inward-facing side configured for placement adjacent a back of a wearer and an outward-facing side and left and right chest panels, each chest panel configured for placement adjacent a chest of the wearer and joined together with the back panel, a front opening is formed between the left and right chest panels, and a pair of arm openings. A plurality of first closure halves that each include a ball portion having a width is disposed on one of the left chest panel or the right chest panel, and a plurality of corresponding second closure halves that include an elastic loop having an opening with a width that is less than the width of the ball portion when the elastic loop is un-stretched and is greater than the width of the ball when the elastic loop is stretched. The plurality of second closure halves are located on the other one of the left chest panel or right chest panel. The left and right chest panels are removably secured together by passing the ball of the first closure half through the opening formed in the elastic loop of the corresponding second closure half such that ball is removably retained by the loop. The back panel and each of the left and right chest panel are formed using a material that includes a first fabric layer, a second fabric layer, and a batting layer disposed between the first and second fabric layers.

In certain embodiments, a split is formed in a bottom end of the back panel and extends vertically upwards along a lower portion of the back panel to provide first and second overlapping and independently-moving divided panel portions. When viewing the outward-facing side of the back panel, the split extends vertically along a vertical midline of the back panel. When viewing the inward-facing side of the back panel, the split extends vertically along a vertical axis that is laterally offset from the midline of the back panel. Certain embodiments include an abutting section where the first divided panel portion overlaps and abuts the second divided panel portion. An abutting face may be provided on an outer surface of the first divided panel that contacts a corresponding abutting face provided on an outer surface of the second divided panel when the first and second divided panels are overlapped and in contact with one another. A friction surface material may be provided on at least one of the abutting faces that contacts the other one of the abutting faces. The friction surface material is formed from a material that is different from a material used in forming the abutting faces. The friction surface material preferably provides a higher degree of resistance to sliding between the abutting faces compared to a degree of resistance to sliding provided between the abutting faces without the friction surface material.

BRIEF DESCRIPTION OF THE DRAWINGS

Further advantages of the invention are apparent by reference to the detailed description when considered in conjunction with the figures, which are not to scale so as to more clearly show the details, wherein like reference numerals represent like elements throughout the several views, and wherein.

DETAILED DESCRIPTION

Figure 1:
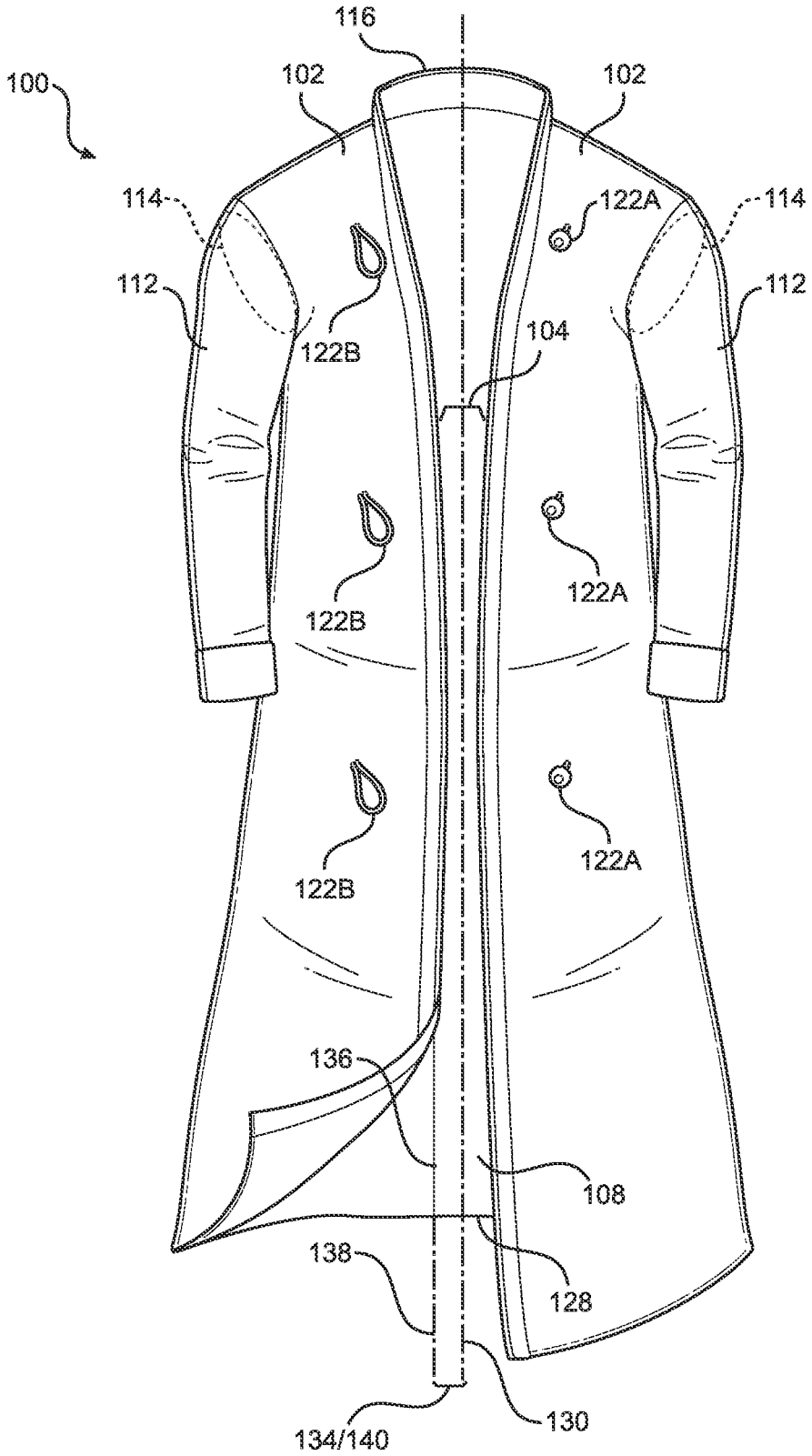
FIG. 1 depicts a front of an article having a quick release closure according to an embodiment of the present invention.
Figure 3:
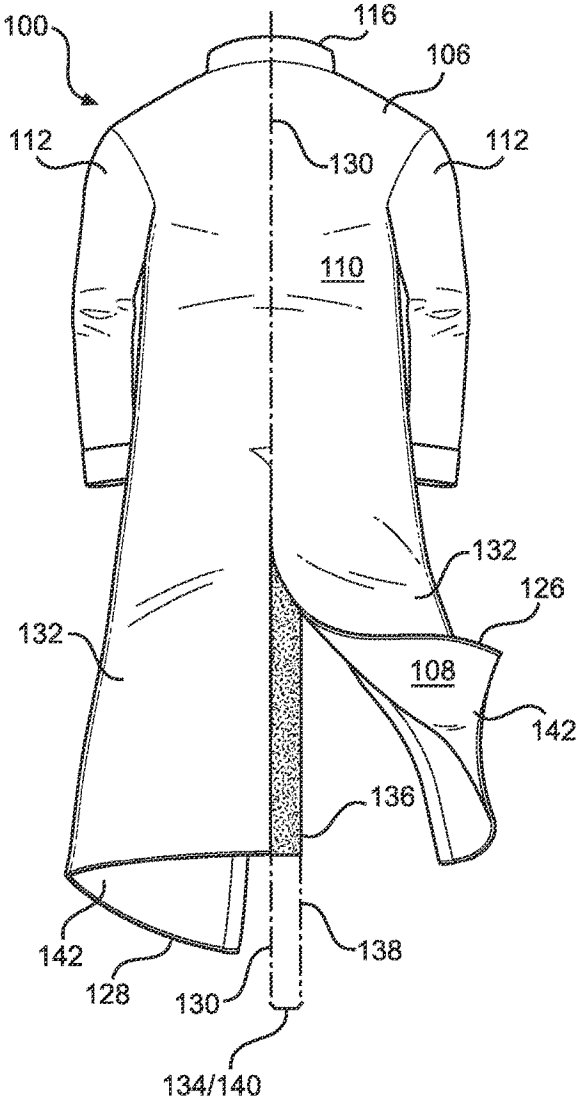
FIGS. 2 and 3 depict a rear of the jacket of FIG. 1.
Figure 2:
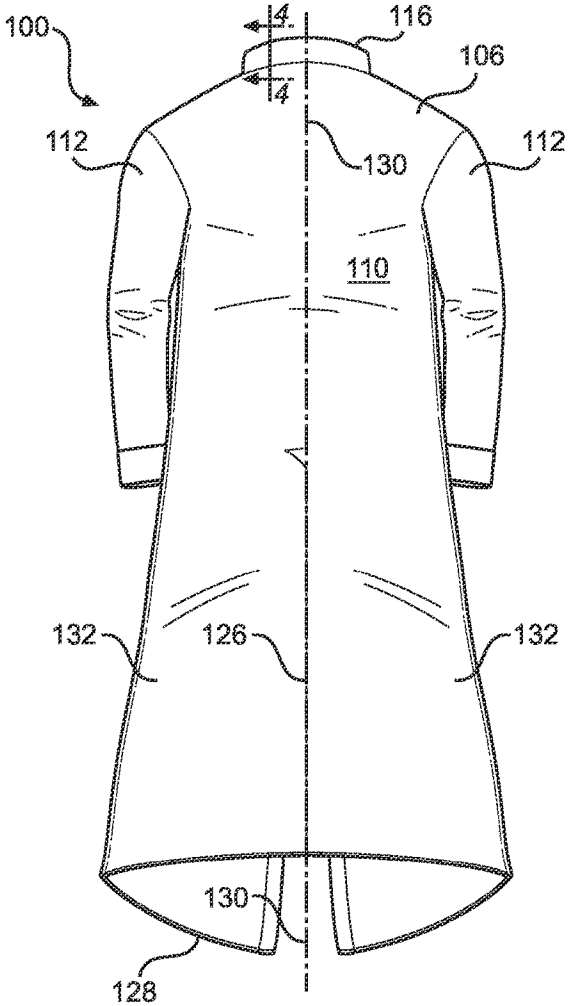

Referring now to the drawings in which like reference characters designate like or corresponding characters throughout the several views, there is shown in FIGS. 1-3, an article 100 according to a first embodiment of the present invention. In this particular embodiment, article 100 is in the style of a jacket or long overcoat. However, the article 100 may have other forms (e.g., waistcoat, hooded jacket, trench coat, vest, etc.). Here, article 100 extends to approximately a wearer's knee or upper thigh area and includes left and right front chest panels 102 that are each configured for placement adjacent a chest of a wearer when the article is worn. A front opening 104 is formed between the chest panels 102 for allowing a wearer to put the article 100 on and take it off. Chest panels 102 are joined together with a single back panel 106 that that includes an inward-facing side 108 that is configured for placement adjacent a back of a wearer when the article 100 is worn and an outward-facing side 110 that faces away from the wearer when the article is worn. Article 100 further includes sleeves 112, preferably long sleeves, which are each joined to the article at arm openings 114. A collar 116, preferably a high collar that extends upwards along the wearer's neck when the article is worn, extends upwards from a neck opening formed at the top edge of the chest and back panels 104, 106.

Figure 4:
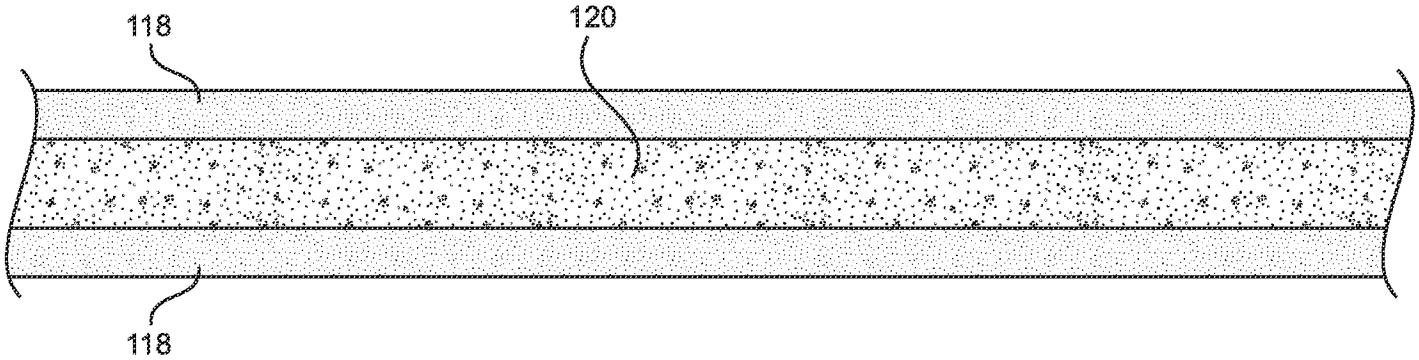
FIG. 4 is a cross-sectional view of a portion of a material used in the forming the article of FIG. 2 taken along line 5-5.

In preferred embodiments, article 100 is formed substantially from a cover or blanket type material that is suitable for at least cool temperatures. Preferably, the material used for article 100 has a temperature rating of 50° or below. With reference to FIG. 4, in certain embodiments, the cover material used in forming the article 100 may include two or more layers of fabric 118 (e.g., quilted nylon) encasing an insulating batting 120 (e.g., polyester batting). For example, in certain embodiments, the cover material used in forming the article 100, is identical to or at least similar to an all-weather "poncho liner" that is often used in the armed forces. Next, the color and pattern used for the material may change depending on the nature and environment of its use. For example, in a military context, approved camouflage patterns may be used.

Figure 5:
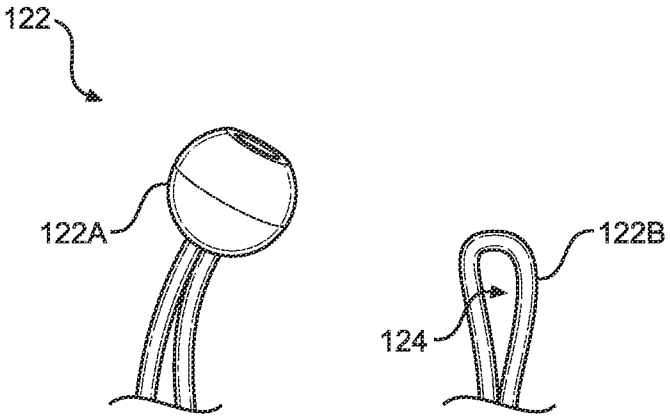
FIG. 5 depicts closure halves that form a quick release closure according an embodiment of the present invention.
Figure 7:
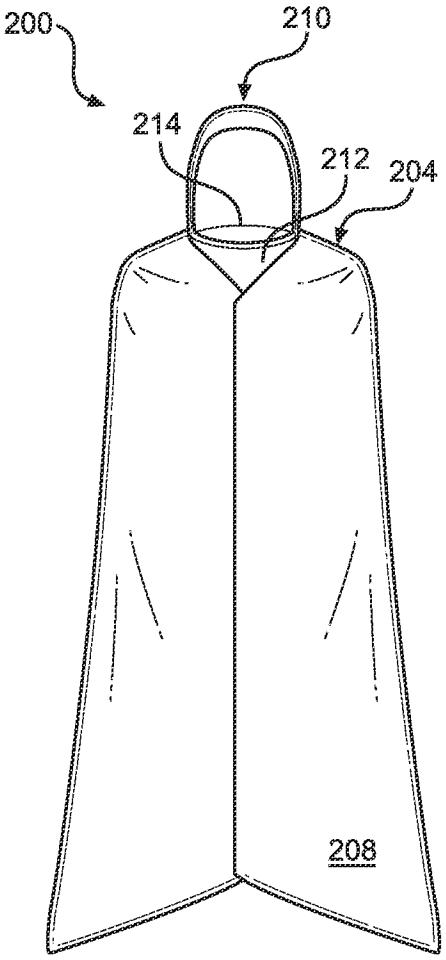
FIGS. 6 and 7 depict an article that includes a hooded cover and a blanket and that includes quick release closures according to an embodiment of the present invention.
Figure 6:
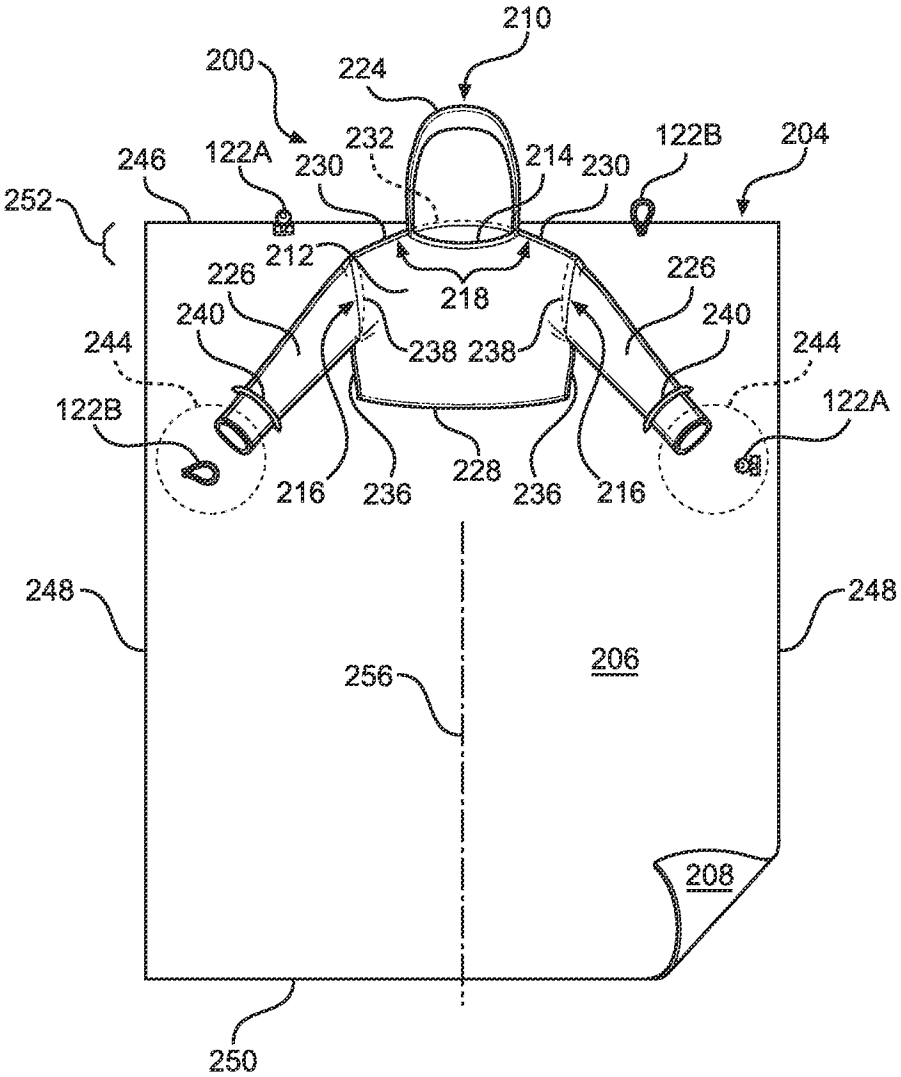
Figure 8:
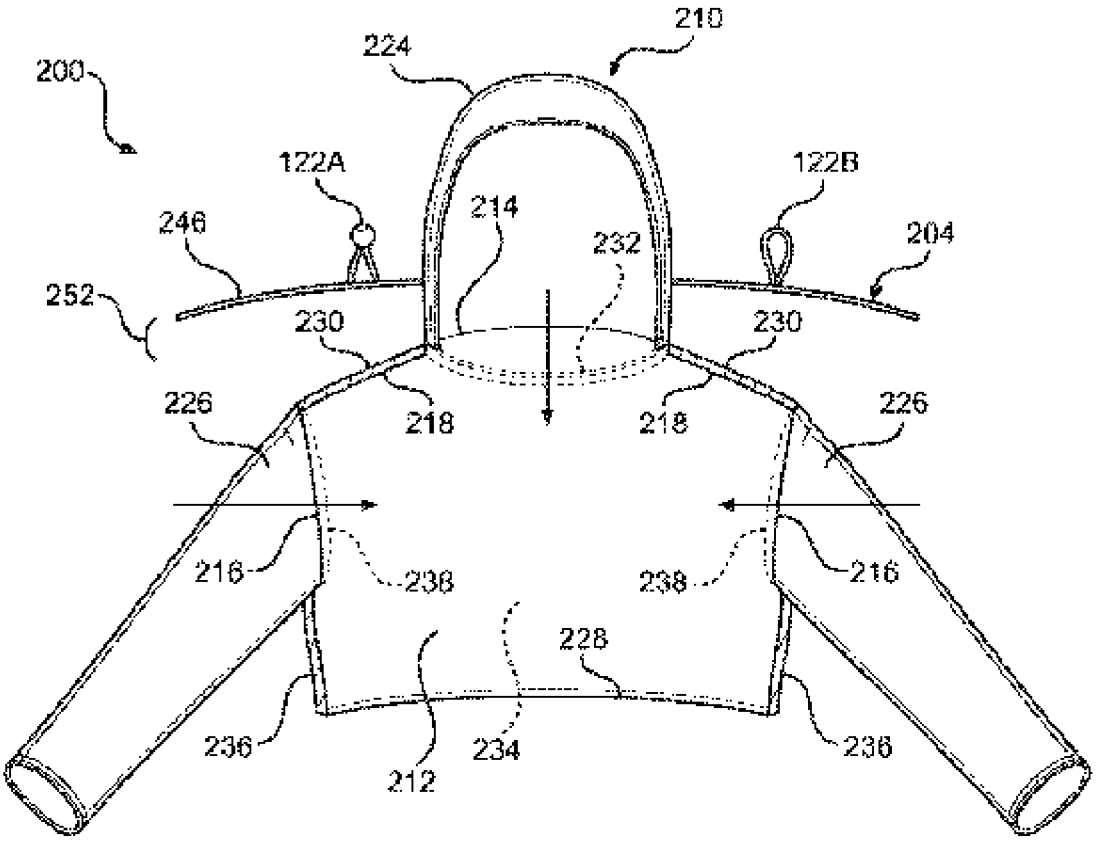
FIG. 8 depicts an upper portion of the article of FIG. 6 in an untucked or use configuration.
Figure 9:
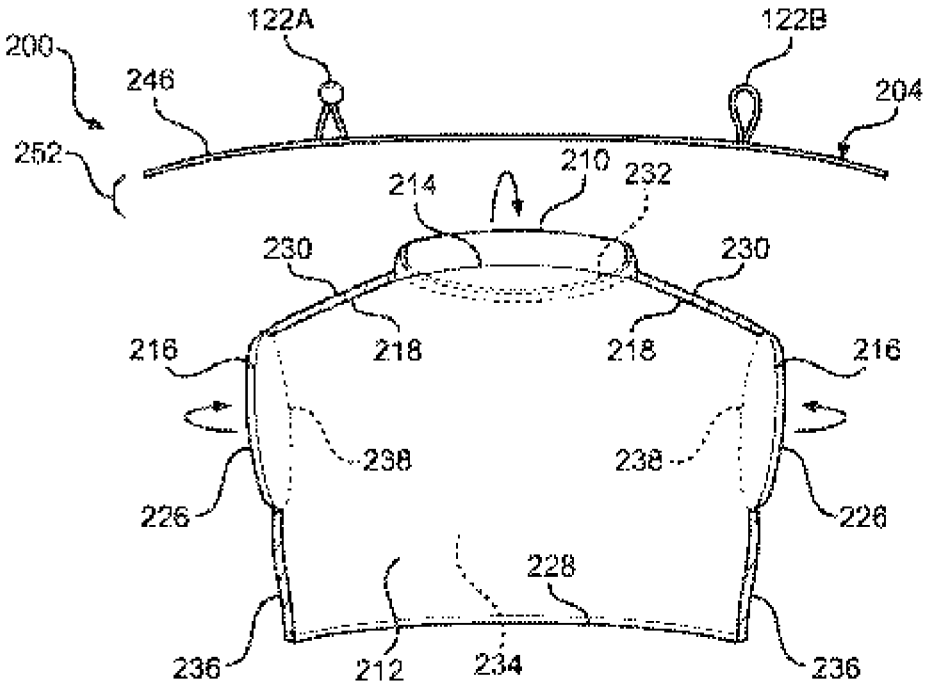
FIG. 9 depicts the article of FIG. 8 in an tucked or stored configuration where a hood and sleeves are tucked into a pocket for storage.
Figure 11:
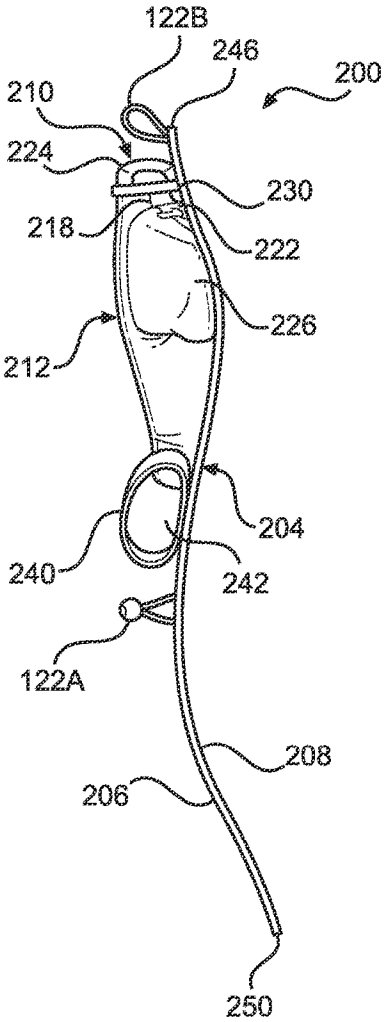
FIG. 11 is a right side view of the article of FIG. 8 with the hood and sleeves in a stored configuration.
Figure 10:
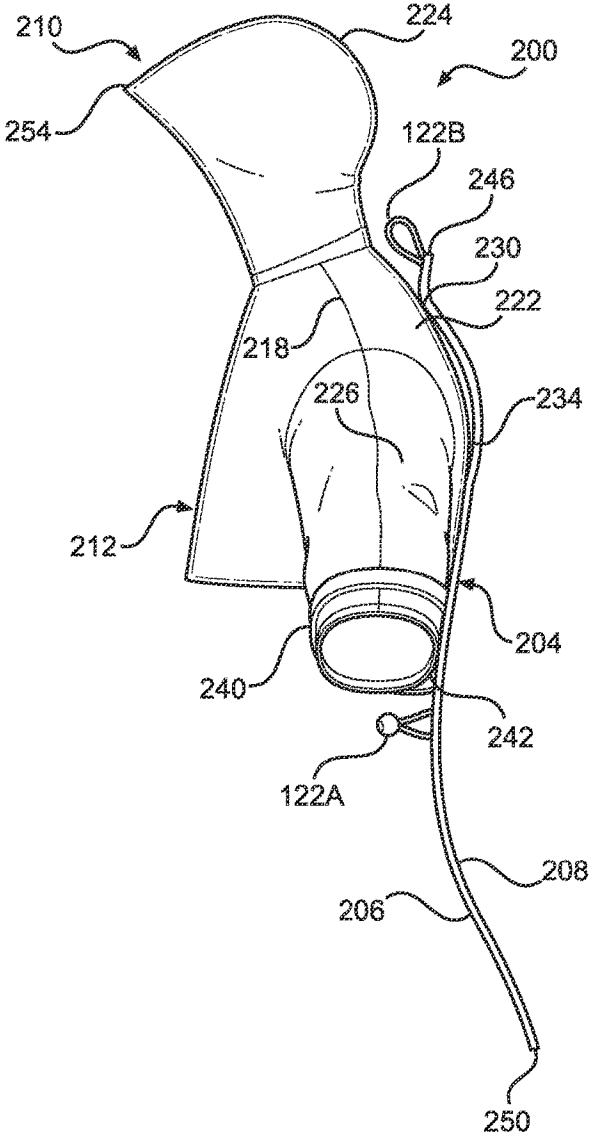
FIG. 10 is a right side view of the article of FIG. 8 with the hood and sleeves in a use configuration.

Returning to FIGS. 1-3 and with further reference to FIG. 5, the primary method for closing the front opening 104 of article 100 is with one or more quick-release closures 122. Each such closure 122 includes a first closure half 122A that is configured to be quickly and removably attached with a second closure half 122B. In the illustrated case, first closure half 122A is a ball and the second closure half 122B is an elastic (i.e., stretchable) loop. Preferably, the ball 122A is sized and configured so that it can be easily grasped and manipulated by a wearer even if that wearer is in adverse conditions, such as wet or cold conditions, where finger dexterity may be impaired, when gloves are in use, etc. For example, in certain embodiments, ball 122A is approximately 1-2 inches in diameter (i.e., its width) and is formed using a hard plastic. Additionally, in certain embodiments, ball 122A is elastically joined to jacket front. Preferably, elastic loop 122B has an opening 124 with a width that, when the loop is not stretched, is smaller in than the diameter of the ball and that, when the loop is stretched, is larger than the diameter of the ball.

The sizing of the ball 122A combined with elasticity of the loop 122B enables the ball to be easily pressed through the loop and for the ball to be retained by the loop to form a closure, even with gloved or clumsy hands. Similarly, the ball 122A may be easily and quickly removed from the loop 122B when necessary. Conventional closures, such as buttons and zippers, require the wearer to find and directly engage the closure mechanism with their hands (i.e., to button/unbutton a button closure or to engage halves of a zipper). For this reason, quickly removing articles with conventional closure mechanisms can be difficult and can damage the article. In this case, however, the elasticity of the loop 122B preferably allows the article 100 to be opened easily by disengaging the ball 122A from the loop by simply pulling the chest panels 102 of the article apart. The loop 122B is preferably resilient enough and elastic enough that this removal process may be accomplished very quickly and without damaging the closure mechanism. Additionally, unlike conventional closure mechanisms where a wearer must actually engage the closure mechanism itself with their hands, a wearer may grasp any portion of the chest panels 102 of the article 100 and pull them apart to remove the article. In removing the article 100, the wearer is not required to directly engage the ball 122A and loop 122B with their hands. Thus, removing the jacket can be accomplished much more quickly in adverse conditions (e.g. dark, wet, etc.) and with gloved hands. In the illustrated embodiments, three separate closure mechanisms 122 are provided on the article 100 at chest, navel and waist locations. However, it may be appreciated that other numbers of closure mechanisms 122 may be provided and may be placed at other locations along the chest panels 102.

Many conventional jackets have a back that is formed as a single continuous section, which causes a number wearer comfort issues. For example, when a wearer sits while wearing a jacket having a one-piece flat back, the tail can become trapped under the wearer and be pulled downwards onto the wearer's neck, which tends to expose the wearer's skin and can cause skin irritation. The presently-disclosed article 100 overcomes this shortcoming by providing a back panel 106 that includes a first split 126 in order to provide a split tail that separates a lower portion of the back panel into left and right independently-movable halves. This provides for a greater degree of freedom of movement as the wearer moves and sits.

Preferably, the first split 126 is formed in a bottom end 128 of the back panel 106 and extends vertically upwards along a lower portion of the back panel to approximately the lower back region of the wearer. The first split 126 is preferably positioned along a vertical midline 130 of the back panel 106. This first split 126, therefore, provides two back panel sections 132 that move independently of one another. However, in preferred embodiments, an overlapping split tail is created by providing an extension section 134 that extends one of the panel sections 132 beyond the midline 130. As such, the width of the inner most panel section 132 also includes the width of the extension section 134 such that its overall width is greater than the overall width of the opposite panel section that does not have an extension section. Providing this type of overlapping split tail provides the freedom of movement discussed above while, at the same time, covering the opening provided between the two panel sections 132 to protect against the intrusion of wind, water, and the like into the article 100.

Providing this extension section 134 produces a second split 136 that extends vertically upwards along a vertical axis 138 that is laterally offset from the midline 130 of the back panel 106. The panel section 132 having the extension section 134 is positioned nearest the wearer. For that reason, when viewing the inward-facing side 108 of the back panel 106, the second split 136 is off center and is laterally offset from the midline 130 of the back panel 106. However, the extension section 134 is covered by the other outermost panel section that does not have the extension section. As such, when viewing the outward-facing side 110 of the back panel 106, the first split 126 is located along the midline 130 and the appearance of a jacket having a tail with a midline split tail is maintained.

It may be appreciated that the two panel sections 132 of the back panel 106 overlap one another to form an abutting section 140. In preferred embodiments, such as the illustrated embodiment, the abutting section 140 includes the entire extension section 134. Corresponding abutting faces 142 are provided at the abutting section 140 on an outer surface of the inner most panel section 132 and the inner surface of the outer-most panel section. Put more simply, at the abutting section 140, a portion of one of the panel sections 132 contacts (i.e., abuts) a portion of the other panel section and these overlapping and contacting portions are referred to as abutting faces. In certain preferred embodiments, the abutting face 142 of one or both of panel sections 132 may be include a friction surface material that is configured to contact the other abutting face. Preferably, the friction surface material is a different material than the material used to form the abutting faces 142. For example, the friction surface material might include leather, fleece, felt, hook and loop fastener material, etc. Additionally, the friction surface material preferably provides a higher degree of resistance to sliding between the abutting faces 142 compared to a degree of resistance to sliding provided between the abutting faces without the friction surface material. Ideally, the friction surface material will tend to keep the two panel section 132 in contact with one another while still allowing them to move as needed. An advantage of this configuration is that the article 100 maintains the uniform appearance of being formed from a single material.

Turning now to FIGS. 6-11, there is provided an article 200 having quick-release closures 122 (first and second closure halves 122A and 122B are shown) according to a second embodiment of the present invention. Article 200 includes a cape or blanket 204 having an inward-facing side 206 and an outward-facing side 208. Article 200 also includes a cover 210 that is mounted to the inward-facing side 206 of the blanket 204. In this particular embodiment, cover 210 is in the style of a hooded half jacket or welder's cape. However, the cover 210 may have other forms (e.g., waistcoat, hooded jacket, trench coat, vest, etc.). Cover 210 is configured to be worn by a wearer by being placed onto and covering at least a portion of the wearer's torso. Furthermore, when the cover 210 is worn, it carries the blanket 204.

The cover 210 includes a torso cover 212 that covers the torso of the wearer that includes a lower opening 228 a head opening 214 that permits the head of the wearer to extend out of the cover and a pair of arm openings 216 that allow arms of the wearer to extend out of the cover when the torso cover is placed onto the torso of the wearer. Additionally, shoulder contact portions 218 are located adjacent opposing sides of the head opening 214 and are configured to contact the shoulders of the wearer when the cover 210 is placed onto the torso of the wearer such that the cover is carried on the shoulders of the wearer. The torso cover 212 includes a chest panel 220 that is placed adjacent the wearer's chest. A back panel 222 of the torso cover 212 is placed between the wearer's back and the inward-facing side 206 of the blanket 204 when the cover is worn.

In certain embodiments, a hood 224 is located proximate the head opening 214 and is configured to cover the wearer's head when the cover 210 is worn and the wearer's head extends out of the head opening. The cover 210 is removably or fixedly attached to the blanket 204 via a pair of first attachments 230 that are located on opposing sides of the head opening 214. In certain embodiments, shoulder portions of the cover 210 are sewn to the blanket 204 and those sewn areas form the shoulder contact portions 218. A first opening 232 where the cover 210 is not attached to the inward-facing 206 side of the blanket 204 is located between the first attachments 230. As shown best in FIG. 11, a pouch area 234 is formed between the back panel 222 of the cover 210 and the inward-facing side 206 of the blanket 204. The hood 224 is sized and configured to be inserted through the first opening 232 and then stored in the pouch area 234.

In certain embodiments, sleeves 226 are located proximate each of the arm openings 216 and each is configured to cover at least a portion of an arm of the wearer when the cover 210 is placed onto the torso of the wearer and the shoulder contacts 218 are disposed on the shoulders of the wearer. Preferably, the sleeves 226 are long sleeves that are each configured to cover substantially the entirety of the wearer's arm. Preferably, a top end of each sleeve is connected to the cover 210 at the arm openings 216 and a bottom end of each sleeve terminated with a hand opening through which a hand of the wearer may extend out of the sleeve.

The cover 210 is removably of fixedly attached to the blanket 204 via a pair of second attachments 236 that are located on opposing sides of the cover and adjacent each sleeve 226. This provides a second opening 238 on each side of the cover 210 where the cover is not attached to the blanket 204. Each second opening 238 is formed between one of the first attachments 230 and one of the second attachments 236. Each of the sleeves 115 sized and configured to be inserted through one of the second openings 238 and then stored in the pouch area 234.

Article 200 also preferably includes separate arm or sleeve retainers 240 that are each configured to selectively hold or join one of the sleeves 226 with a portion of the blanket 204. When a wearer's arms are in the sleeves 226 and the sleeves are joined with the blanket 204 by the sleeve retainers 240, movement of the wearer's arms within the sleeves causes the blanket to move with the wearer's arms. On the other hand, when a wearer's arms are in the sleeves 226 and the sleeves are not joined with blanket 204 by the sleeve retainers 240, movement of the wearer's arms within the sleeves does not cause the blanket to move with the wearer's arms. Therefore, the wearer can make free use of his arms. In certain embodiments, the sleeve retainers 240 are elastic retainers connected to the blanket 204 that form an opening 242 through which one of the sleeves 226 may be inserted in order to be selectively held together with the blanket. In certain embodiments, when the wearer's arm is inserted through the opening 242 of the sleeve retainer 240, the sleeve retainer is positioned between an elbow and a wrist of the wearer.

As mentioned above, article 200 is provided quick-release closures 122 (first and second closure halves 122A and 122B are shown) that may be used to removably connect one portion of the article 200 together with another portion of the article. For example, in certain embodiments, closures 122 (e.g., first and second closure halves 122A, 122B) are located such that they may be grasped by hands of the wearer and joined together in order to connect the left and right portions of the blanket 204 together such that the blanket surrounds the wearer. More preferably, closures 122 are located within a grasping area 244 that surrounds the bottom end of each sleeve 226 such that they may be easily grasped by the wearer's hands when the wearer's arms are inserted through the openings 242 of the arm retainers 240. In other embodiments, closures 122 are located along a top end 246 of the blanket 204 on either side of the head opening 214 such that, when the closures are joined together and the head of the wearer extends out of the head opening, the blanket is secured around a neck of the wearer. In still other embodiments, closures 122 are located around the perimeter of the blanket 204, including the sides 248 and/or bottom 250 of the blanket. Preferably, the closures 122 are connected to the inward-facing side 206 of the blanket 204. As such, when the blanket 204 is closed around the wearer, the closures 122 can be accessed by the wearer's hands inside of the blanket.

Like article 100, the materials used in the construction of at least certain portions of article 200, including particularly the blanket 204, are preferably those of a poncho liner (e.g., two or more layers of quilted nylon encasing a polyester batting), as depicted in FIG. 4. The blanket 204 in this particular case is formed from a rectangular section of material that measures approximately 62 inches by 84 inches. The size of the blanket 204 is adjusted depending on the size of the wearer. In certain preferred embodiments, the blanket 204 is sized and configured to extend below knees of a wearer when the shoulder contacts 218 of the cover 210 are disposed on the shoulders of the wearer.

The cover 210 is preferably attached to the blanket 204 such that the top of the shoulder portions (i.e., first attachments 230) are just below the top edge 246 of the blanket (e.g., 2-6 inches below the top edge). This provides a top section 252 of the blanket 204 that extends upwards beyond the tops of the wearer's shoulders and extends from the left side of the blanket to the right side of the blanket. When the wearer wraps the blanket 204 around his shoulders, the top edge 246 of the blanket extends past the wearer's shoulders and up along the wearer's neck. This helps to create a more secure seal between the blanket and the wearer to keep rain, snow, cold, etc. out of the blanket 204. Preferably, in certain embodiments, the chest panel 220 of the cover 210 extends only down to the mid-chest area to allow other gear (e.g., military, police, etc.) to be worn and used simultaneously with the article 200. Similarly, the hood 224 is sized to have a peak 254 at the wearer's forehead so that the hood does not extend downwards past the wearer's eyes. This allows the wearer to use head equipment while simultaneously wearing the hood.

To wear the cover 210, a wearer places his head first through a lower opening 228 and then out through the head opening 214 at the top of the cover and then, optionally, into the hood 224. The wearer then places an arm into each sleeve 226 via arm openings 216 located on left and right sides of the cover 210. Preferably, elastic straps 240 are attached the inside surface 206 of the blanket 204 on each side of the wearer. These straps 240 are preferably sized and positioned such that, after the wearer has placed his arms into the sleeves 126, he may then insert his arm through the strap 240. The straps 240 allow the wearer to easily close the blanket 204 around himself simply by crossing his arms. At the same time, by removing his arms from the straps 240, the wearer can have free, unencumbered use of his arms. In other embodiments, quick-release closures 122 (e.g., ball 122A and elastic loop 122B) are located on the inward-facing side 206 of the blanket 204. When these closures 122 are utilized, the ball 122A is preferably attached along the edge 248 of the blanket 204 and the elastic loop 122B is attached closer to a midline 256 of the blanket. This enables for the blanket 204 to be closed more easily and more securely.

The article 200 may be used as a blanket by storing the hood 224 and sleeves 226. As previously described, the hood 224 may be inserted into a hood opening (i.e., first opening 232) and the sleeves 226 may each be inserted into sleeve openings (i.e., second openings 238) such that the hood and sleeve are stored in the pouch area 234 formed between the blanket 204 and the back panel 222 of the torso cover 212. In other cases, the hood 224 may be tucked into the head opening 214 and the sleeves 226 may be tucked into the arm openings 216 such that they are located within the cover 210 between chest panel 220 and the back panel 222. In each of the above cases, the pockets (i.e., pocket within the cover 210 or behind the cover) may be sealed so as to secure the hood 224 and sleeves 226. This may accomplished, for example, by placing a zipper, hook and loop, or other suitable fastener at the lower and upper openings 214, 228, 232 of the cover 210 and at each of the sleeve openings 216, 238. This would allow those openings to be closed in order to form an enclosed pocket (i.e., within the vest or between the vest and the blanket). In preferred embodiments, this enclosed pocket is water resistant.

Although this description contains many specifics, these should not be construed as limiting the scope of the invention but as merely providing illustrations of some of the presently preferred embodiments thereof, as well as the best mode contemplated by the inventor of carrying out the invention. The invention, as described herein, is susceptible to various modifications and adaptations as would be appreciated by those having ordinary skill in the art to which the invention relates.

What is claimed is:

1. A multi-use article comprising:

a blanket having an inward-facing side and an outward-facing side;

a cover mounted to the inward-facing side of the blanket and configured to be worn by a wearer by being placed onto and covering at least a portion of a torso of the wearer and, when worn, to carry the blanket; and a head opening configured to permit a head of the wearer to extend out of the cover when the cover is placed onto the torso of the wearer, the cover including:

a pair of arm openings configured to allow arms of the wearer to extend out of the cover when the cover is placed onto the torso of the wearer;

first and second shoulder contact portions, respectively, located adjacent opposing sides of the head opening, each shoulder contact portion configured to contact a respective shoulder of the wearer when the cover is placed onto the torso of the wearer such that the cover is carried on the shoulders of the wearer;

a chest panel that is adapted to be disposed adjacent a chest of the wearer and a back panel that is adapted to be disposed adjacent a back of the wearer and between the wearer and the inward-facing side of the blanket when the shoulder contact portions are disposed on the shoulders of the wearer;

a hood located proximate the head opening that is configured to cover the head of the wearer when the cover is placed onto the torso of the wearer, the head of the wearer extends out of the head opening, and the shoulder contact portions are disposed on the shoulders of the wearer;

first attachments that are located on the opposing sides of the head opening where the cover is attached to the inward-facing side of the blanket;

a first opening located between the first attachments where the cover is not attached to the inward-facing side of the blanket;

a pouch area formed between the back panel of the cover and the inward-facing side of the blanket, wherein the hood may be tucked for storage in the pouch area by being inserted through the first opening and into the pouch area;

first and second sleeves located proximate each arm opening, respectively, the first and second sleeves being configured to cover a respective one of the arms of the wearer when the cover is placed onto the torso of the wearer and the shoulder contact portions are disposed on the shoulders of the wearer;

second attachments that are located on opposing sides of the cover where the cover is attached to the blanket, wherein one of the second attachments is respectively disposed adjacent each sleeve; and a second opening formed on each side of the cover where the cover is not attached to the blanket, wherein each second opening is formed between one of the first attachments and one of the second attachments, wherein each sleeve may be inserted through one of the second openings and stored inside of the pouch area.

2. The article of claim 1 further comprising a separate sleeve retainer configured to selectively hold each sleeve together with a portion of the blanket such that, (i) when the wearer's arms are in the sleeves and the sleeves are held against the blanket by the sleeve retainers, movement of the wearer's arms within the sleeves causes said portions of the blanket to move with the wearer's arms and, (ii) when the wearer's arms are in the sleeves and the sleeves are not held against the blanket by the sleeve retainers, movement of the wearer's arms within the sleeves does not cause said portions of the blanket to move with the wearer's arms.

3. The article of claim 2 wherein the sleeve retainers are elastic retainers attached to the blanket and each elastic retainer forms a respective opening through which one of the sleeves may be inserted in order to be selectively held together with said portion of the blanket.

4. The article of claim 1 wherein the sleeves are long sleeves that are each configured to cover substantially an entirety of the arm, a top end of each respective sleeve attached to the cover at the respective arm openings and a bottom end of each sleeve terminated with a respective hand opening through which a respective hand of the wearer may extend out of the respective sleeve.

5. The article of claim 1 further comprising a first closure half and a corresponding second closure half that are attached to opposing left and right portions of the blanket and on either side of the cover, wherein the first and second closure halves may be selectively joined together in order to connect the left and right portions of the blanket together such that the blanket surrounds the wearer when worn.

6. The article of claim 5 further comprising separate arm retainers respectively attached to the opposing left and right portions of the blanket and on either side of the cover, each arm retainer having an opening through which a portion of a respective one of the arms of the wearer may be placed such that: (i) when the wearer's arms are in the arm retainers, movement of the wearer's arms causes the blanket to move with the movement of the wearer's arms and, (ii) when the wearer's arms are not in the arm retainers, movement of the wearer's arms does not cause the blanket to move with the movement of the wearer's arms.

7. The article of claim 6 wherein the respective arm retainer is located on the blanket such that, when the wearer's respective arm is inserted through the opening of the respective arm retainer, the arm retainer is positioned between an elbow and a wrist of the wearer, and wherein the first and second closure halves are located such that the first and second closure halves may be grasped by hands of the wearer and joined together in order to connect the left and right portions of the blanket together such that the blanket surrounds the wearer when the wearer's respective arms are inserted through the openings of the respective arm retainers.

8. The article of claim 5 wherein the first and second closure halves are located proximate a top end of the blanket on either side of the head opening such that, when the closure halves are joined together and the head of the wearer extends out of the head opening, the blanket is secured around a neck of the wearer.

9. The article of claim 5 wherein the first and second closure halves are attached to the inward-facing side of the blanket.

10. The article of claim 5 wherein the first closure half includes a ball portion and the second closure half includes an elastic loop, wherein the first and second closure halves are joined together by passing the ball portion through an opening formed in the elastic loop such that ball portion is removably retained by the loop.

11. The article of claim 1 wherein the blanket is sized and configured to extend below knees of the wearer when the shoulder contact portions of the cover are disposed on the shoulders of the wearer.

12. The article of claim 1 wherein the blanket comprises a first fabric layer, a second fabric layer, and a batting layer disposed between the first and second fabric layers.

13. A multi-use article comprising:

a blanket having an inward-facing side and an outward-facing side;

a jacket having a top end and a bottom end and mounted to the inward-facing side of the blanket and configured to be worn by a wearer by being placed onto and covering at least a portion of a torso of the wearer and, when worn, to carry the blanket; and a pouch area formed between the inward-facing side of the blanket and the jacket, the jacket including:

a chest panel that is configured to be disposed adjacent a chest of the wearer;

a back panel having an inward-facing side configured for placement adjacent a back of the wearer and an outward-facing side that is opposite the inward-facing side of the back panel;

a head opening formed at the top end of the jacket, the head opening having opposing sides, wherein the top end of the jacket is joined with the blanket via a pair of first attachments, wherein one of the pair of first attachments is located on each respective side of the head opening;

a pair of arm openings, wherein opposing side portions of the jacket are joined with the blanket via a pair of second attachments, wherein one of the pair of second attachments is located between each respective arm opening and the bottom end of the jacket;

a hood formed at the head opening;

first and second sleeves respectively formed at each of the arm openings;

a first opening formed between the first attachments, wherein the first opening is sized and configured to allow the hood to be tucked for storage into the pouch area by being inserted through the first opening; and a second opening formed between one of the first attachments and a corresponding one of the second attachments on each of the opposing sides of the jacket, wherein the second openings are each sized and configured to allow one of the sleeves to be tucked for storage into the pouch area by being inserted through the second opening.

14. A multi-use article comprising:

a blanket having an inward-facing side and an outward-facing side;

a cover mounted to the inward-facing side of the blanket and configured to be worn by a wearer by being placed onto and covering at least a portion of a torso of the wearer and, when worn, to carry the blanket, the cover including:

a chest panel that is adapted to be disposed adjacent a chest of the wearer;

a back panel that is adapted to be disposed adjacent a back of the wearer and between the wearer and the inward-facing side of the blanket when the cover is placed onto the torso of the wearer;

a head opening configured to permit a head of the wearer to extend out of the cover when the cover is placed onto the torso of the wearer;

a hood located proximate the head opening that is configured to cover the head of the wearer when the cover is placed onto the torso of the wearer and the head of the wearer extends out of the head opening;

a pair of arm openings configured to allow arms of the wearer to extend out of the cover when the cover is placed onto the torso of the wearer;

first and second sleeves respectively located proximate the arm openings that are each configured to cover at least a portion of a respective one of the arms of the wearer;

a pouch area formed between the back panel of the cover and inward-facing side of the blanket;

first attachments that are located on opposing sides of the head opening where the cover is attached to the inward-facing side of the blanket;

second attachments that are located on opposing sides of the cover where the cover is attached to the blanket, wherein one of the second attachments is respectively disposed adjacent each arm opening;

a first opening formed between the first attachments, wherein the first opening is sized and configured to allow the hood to be tucked for storage into the pouch area by being inserted through the first opening;

a second opening formed between one of the first attachments and a corresponding one of the second attachments on each of the opposing sides of the jacket, wherein the second openings are each sized and configured to allow one of the sleeves to be tucked for storage into the pouch area by being inserted through the respective second opening; and a first closure half and a corresponding second closure half that are each attached to opposing left and right portions of the inward-facing side of the blanket, wherein the blanket is configured to surround the wearer and the first and second closure halves may be connected together by the wearer entirely from within the blanket and while the blanket surrounds the wearer in order to connect the left and right portions of the blanket together around the wearer;

wherein the first closure half includes a ball portion and the second closure half includes an elastic loop, wherein the first and second closure halves are joined together by passing the ball portion through an opening formed in the elastic loops such that the ball portion is removably retained by the loop.

* * * * *